US008297327B2

(12) United States Patent
Hardy

(10) Patent No.: US 8,297,327 B2
(45) Date of Patent: Oct. 30, 2012

(54) HAND HELD DUAL SIDED TAPE DISPENSING MACHINE

(76) Inventor: Thelbert David Hardy, Pascagoula, MS (US)

( * ) Notice: Subject to any disclaimer, the term of this patent is extended or adjusted under 35 U.S.C. 154(b) by 236 days.

(21) Appl. No.: 12/800,731

(22) Filed: May 21, 2010

(65) Prior Publication Data

US 2010/0300625 A1 Dec. 2, 2010

Related U.S. Application Data

(60) Provisional application No. 61/217,093, filed on May 27, 2009.

(51) Int. Cl.

| | |
|---|---|
| ***B32B 37/16*** | (2006.01) |
| ***B32B 37/20*** | (2006.01) |
| ***B32B 38/04*** | (2006.01) |
| ***B44C 7/04*** | (2006.01) |
| ***B44C 7/06*** | (2006.01) |

(52) U.S. Cl. ..... 156/526; 156/510; 156/523; 156/527; 156/574; 156/577; 156/579

(58) Field of Classification Search ..... 156/510, 156/523, 526, 527, 574, 577, 579
See application file for complete search history.

(56) References Cited

U.S. PATENT DOCUMENTS

| | | | | |
|---|---|---|---|---|
| 4,415,400 | A * | 11/1983 | Rammelmeyr | 156/555 |
| 4,989,769 | A * | 2/1991 | Longworth et al. | 225/20 |
| 5,445,703 | A * | 8/1995 | Steeves et al. | 156/544 |
| 5,683,542 | A * | 11/1997 | Poole | 156/494 |

* cited by examiner

*Primary Examiner* — Mark A Osele
*Assistant Examiner* — Christopher C Caillouet

(57) ABSTRACT

A hand held adhesive tape dispensing machine for joining tape strips originating from two tape rolls to form one tape strip of a desired length with partially exposed adhesive on both sides, which has an offset frame structure supporting guide members to maintain tape positions; roller that tape strips join on; spools that can accommodate varying widths of tape; cutting blade for severing tape; and handle for grasping.

1 Claim, 18 Drawing Sheets

FIG.7
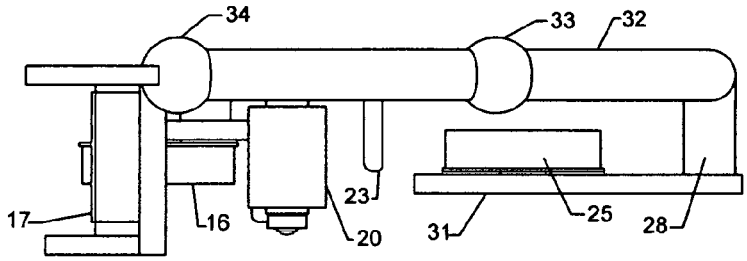
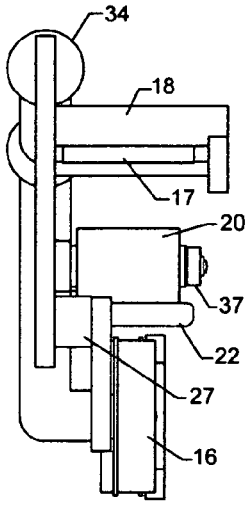
FIG.8
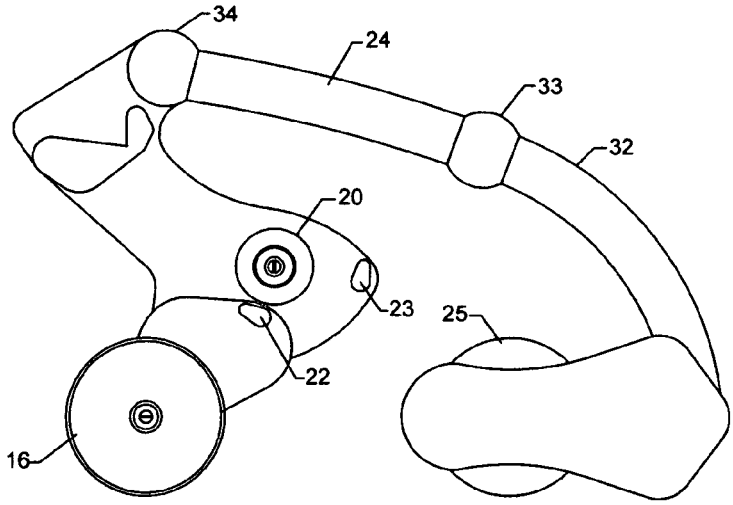
FIG.9

FIG. 13
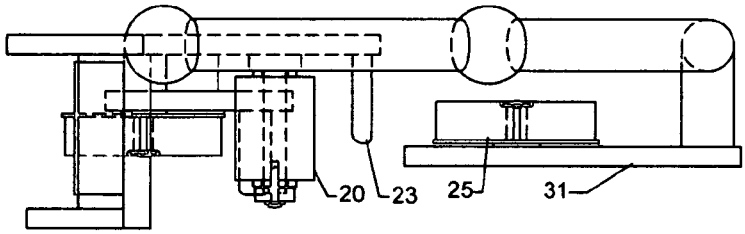
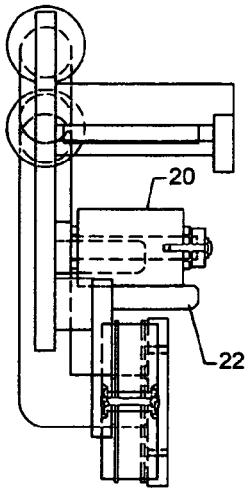
FIG. 14
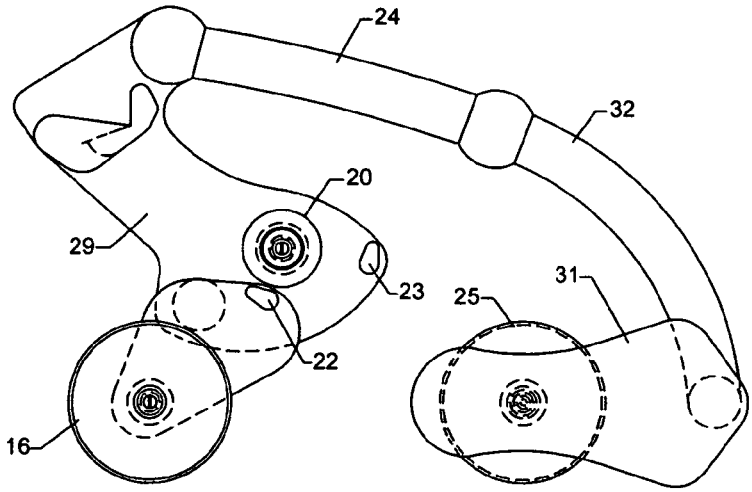
FIG. 15

HAND HELD DUAL SIDED TAPE DISPENSING MACHINE

CROSS-REFERENCE TO RELATED APPLICATIONS

This application claims the benefit of provisional patent application Ser. No. 61/217,093, filed May 27, 2009 by the present inventor.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This application relates to masking tape dispensing machines, especially those that are used in a hand-held manner and for the purpose of aiding in the masking or protecting of surfaces prior to application of paint or other similar materials to nearby surfaces.

2. Related Art

Adhesive tape dispensing machines are commonly used to aid in the masking or protecting process prior to applying materials such as paint to various surfaces. Dispensed tapes are sometimes used in conjunction with paper or plastic sheeting to cover areas that need to be protected from stray paint drops or overspray. One device U.S. Pat. No. 5,628,866 to Pool (1997) can be used to join the tape to plastic sheeting for an end product being a sheet of plastic that has a partially exposed adhesive tape along its edge. However the custom plastic sheeting required with this system is considerably more expensive per square foot than larger rolls of plastic sheeting. Another tape dispensing machine used for masking purposes U.S. Pat. No. 4,981,537 to Heil, Longworth (1991) shows a device that joins separate adhesive tape strips with the end product being a single tape strip that has adhesive on both sides. The single tape strip is applied to the surface to be protected then plastic sheeting can be applied to the exposed adhesive on the tape strip. This device requires special custom tapes from factory to work properly. These special factory custom tapes are expensive and difficult to come by as they are not usually part of standard stock in supply stores. Other related machines such as U.S. Pat. No. 4,415,400 to Rammelmeyr (1983) and U.S. Pat. No. 7,028,736 to Miller (2006) join standard stock adhesive tapes together with a similar end product being a single tape strip that has partially exposed adhesive on both sides.

However Rammelmeyr and Miller designs seem to be lacking in that they do not appear to provide for a device that can be operated in a non cumbersome, easily accessible, hand-held manner. Each related art device mentioned falls short in some respect as to practical usage thus not fulfilling the long felt, long needed desire for a device that accomplishes the design goals that should be implemented. While some of the related art mentioned have had a degree of commercial success for a limited time there is still a need in the art for an improved tape dispensing machine that can overcome the limitations of such tape dispensing machines.

However Rammelmeyr and Miller designs seem to be lacking in that they do not appear to provide for a device that can be operated in a non cumbersome, easily accessible, hand-held manner. Each related art device mentioned falls short in some respect as to practical usage thus not fulfilling the long felt, long needed desire for a device that accomplishes the design goals that should be implemented. While some of the related art mentioned have had a degree of commercial success for a limited time there is still a need in the art for an improved tape dispensing machine that can overcome the limitations of such tape dispensing machines.

BRIEF SUMMARY OF INVENTION

In accordance with one embodiment a tape dispensing machine comprising a frame structure of multiple sections with attached handle, axles, guide members, blade support and safety guard. A roller and spools are rotatatbly attached to the axles and a cutting blade is attached to the blade support. The manually operated machine combines two adhesive tape strips into one strip that has partially exposed adhesive on both sides. After being dispensed to a desired length the strip can then be severed by the cutting blade that is provided. The configuration or positioning of the elements mentioned as a whole and the frame design contribute to solving usage problems that have longtime existed in related art devices. Examples of problems solved are ease of access to operational parts, usage in a non-cumbersome hand-held manner is enabled, time saving made possible and more economical to use.

BRIEF DESCRIPTION OF THE SEVERAL VIEWS OF THE DRAWINGS

FIG. 7 is a Top Plan view of a preferred tape dispenser of the present invention.

FIG. 8 is a Front Elevational view of a preferred tape dispenser of the present invention.

FIG. 9 is a Left Side Elevational view of a preferred tape dispenser of the present invention.

FIG. 13 is a Top Plan view of a preferred tape dispenser of the present invention, with hidden lines shown.

FIG. 14 is a Front Elevational view of a preferred tape dispenser of the present invention, with hidden lines shown.

FIG. 15 is a Left Side Elevational view of a preferred tape dispenser of the present invention, with hidden lines shown.

| DRAWING REFERENCE NUMBERS | |
|---|---|
| 15 | Cutting Blade Guard |
| 16 | Front Spool |
| 17 | Cutting Blade |
| 18 | Cutting Blade Support |
| 19 | Front Spool Axle |
| 20 | Roller |
| 21 | Roller Axle |
| 22 | Front Guide Member |
| 23 | Rear Guide Member |
| 24 | Handle |
| 25 | Rear Spool |
| 26 | Rear Spool Axle |
| 27 | Forward Frame Offset |
| 28 | Rear Frame Offset |
| 29 | Upper Forward Frame Section |
| 30 | Lower Forward Frame Section |
| 31 | Lower Rear Frame Section |
| 32 | Upper Rear Frame Section |
| 33 | Rear Handle End |
| 34 | Forward Handle End |
| 35 | Front Spool Screw |
| 36 | Front Spool Washer |
| 37 | Roller End Cap |
| 38 | Roller End Cap Washer |
| 39 | Roller End Cap Screw |
| 40 | Rear Spool Washer |
| 41 | Rear Spool Screw |
| 42 | Front Roll of Tape |
| 43 | Rear Roll of Tape |

DETAILED DESCRIPTION OF ONE EMBODIMENT OF INVENTION

Figure 18:
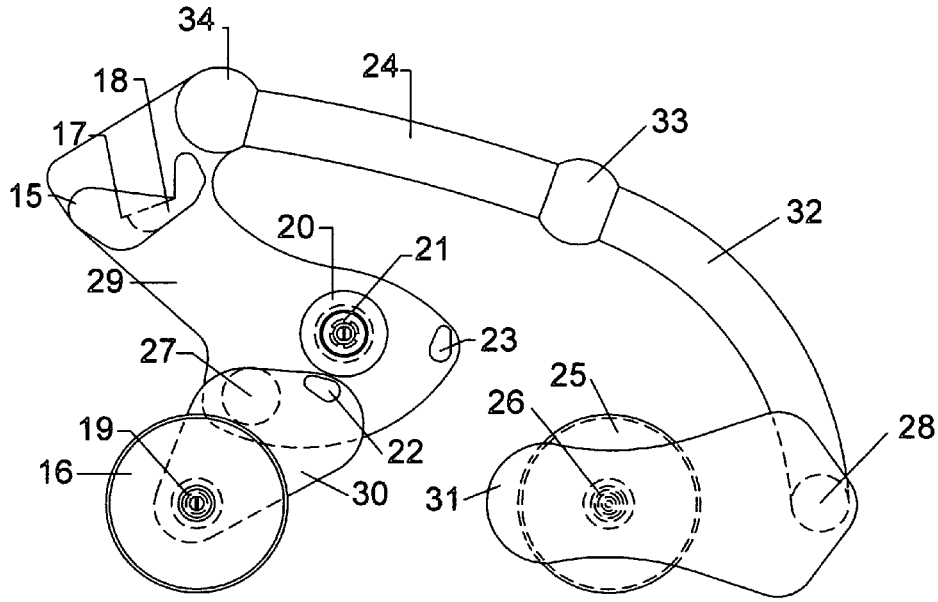
FIG. 18 is a Left Side Elevational view of a preferred tape dispenser of the present invention, with hidden lines shown and reference numbers shown with leader lines to corresponding parts.
Figure 19:
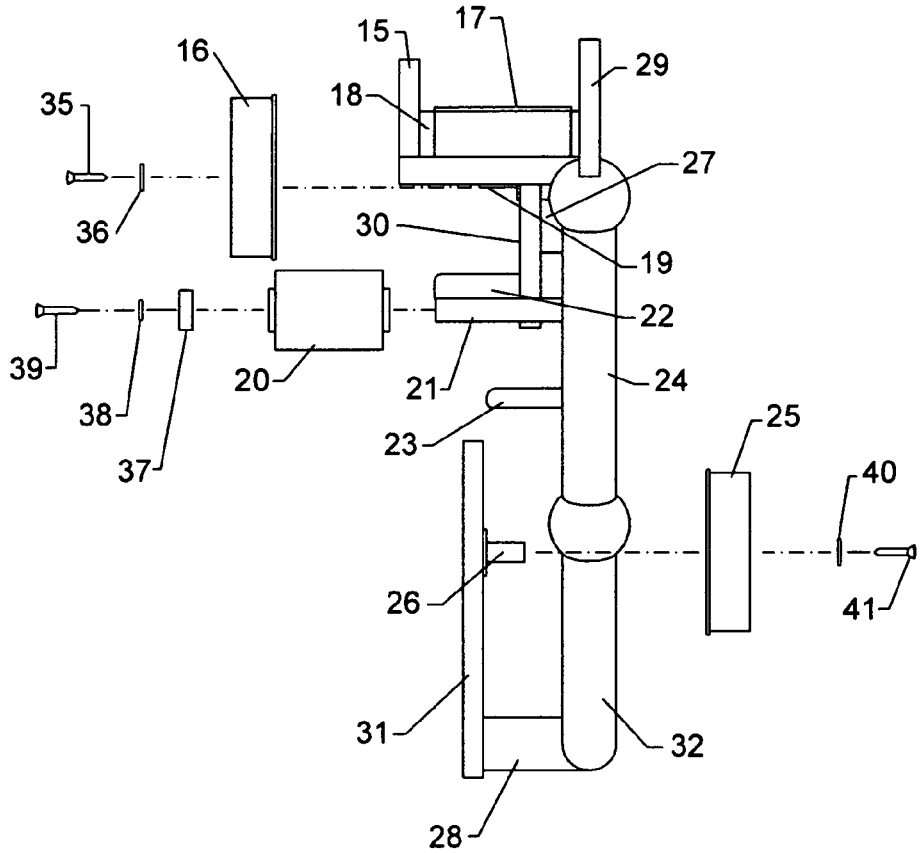
FIG. 19 is an Exploded Top Plan view of a preferred tape dispenser of the present invention, with reference numbers and leader lines to the corresponding parts shown.

Element numbers in FIGS. 1-17 correspond to elements in FIGS. 18-22 described in detail below. In FIG. 18 the main structural parts of the Hand Held Dual Sided Tape Dispensing Machine are shown as the Upper Forward Frame Section 29, Lower Forward Frame Section 30, Lower Rear Frame Section 31, Upper Rear Frame Section 32, Rear Handle End 33, Handle 24, Forward Handle End 34, Forward Frame Offset 27 and Rear Frame Offset 28. These mentioned parts being formed as a single structure is currently contemplated. The method of manufacture is contemplated as being the plastic mold injection process. However the parts could be made separately and from various other materials and then joined together by varying means. In this embodiment the Upper Forward Frame Section 29, Lower Forward Frame Section 30 and Lower Rear Frame Section 31 are flat. The Handle 24, Upper Rear Frame Section 32, Forward Frame Offset 27 and Rear Frame Offset 28 are cylindrical in shape in this embodiment but could have varying shapes. As an example of different shapes, the Upper Rear Frame Section 32 could be flat with the same thickness as the Upper Forward Frame Section 29. In FIG. 19 the Lower Rear Frame Section 31 and Upper Rear Frame Section 32 are shown connected together by the Rear Frame Offset 28. The Rear Spool Axle 26 is attached to or molded as part of the Lower Rear Frame Section 31. The Rear Guide Member 23 is attached to or molded as part of the Upper Forward Frame Section 29 that is better seen in FIG. 11. FIG. 19 also shows the Roller Axle 21. It is attached to or molded as part of the Upper Forward Frame Section 29 which is seen better in FIG. 20.

Figure 20:
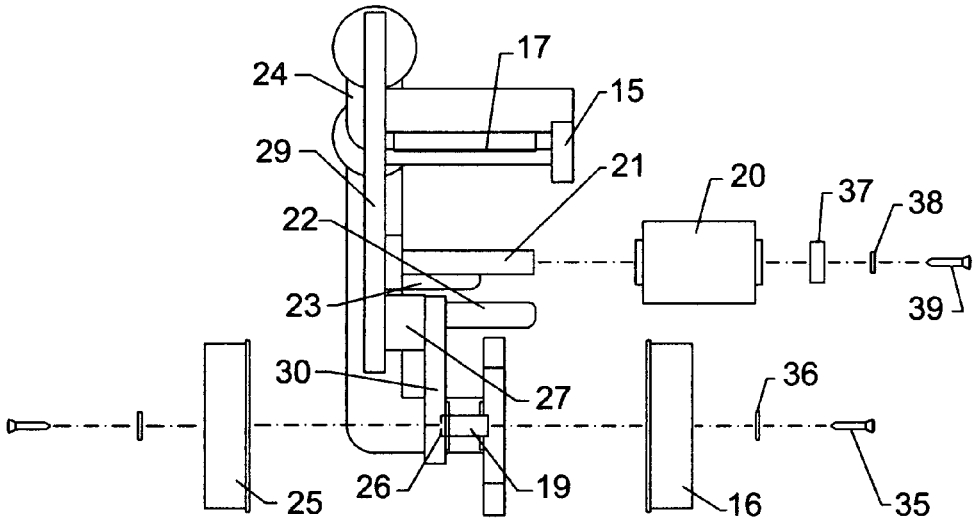
FIG. 20 is an Exploded Front Elevational view of a preferred tape dispenser of the present invention, with reference numbers shown. The Rear Spool Axle 26 is shown with hidden lines.

The Cutting Blade Support 18 as shown in FIG. 19 and FIG. 18 is molded as part of the Upper Forward Frame Section 29. As with the other parts of the machine it could be connected by other means also. The Cutting Blade Guard 15 is attached to or can be an integral part of the Cutting Blade Support 18 as shown in FIG. 19 and FIG. 18. The shape of the Cutting Blade Guard 15, as with all of the machine parts, should not be construed as being confined to the illustrations. However the relative general location of the parts as configured would remain the same with respect to each other with this embodiment. The Cutting Blade 17 could be made of metal. It is attached adhesively and or by screws or some other means to the Cutting Blade Support 18. In FIG. 20 the Roller Axle 21 and Front Spool Axle 19 are more clearly seen with regard to the parts they are connected to. The Front Spool Axle 19 is shown as being connected to or formed as part of the Lower Forward Frame Section 30. The Roller Axle 21 is shown as being connected to the Upper Forward Frame Section 29. In FIGS. 20, 19 and 18 the Forward Frame Offset 27 is shown. It is the connecting part between the Lower Forward Frame Section 30 and the Upper Forward Frame Section 29. The following parts relationship can be seen in FIG. 20. The Roller 20 is rotatably attached to Roller Axle 21. The Roller End Cap 37 is mounted by some means onto the end of the Roller Axle 21 and holds the Roller 20 in place.

Figure 1:
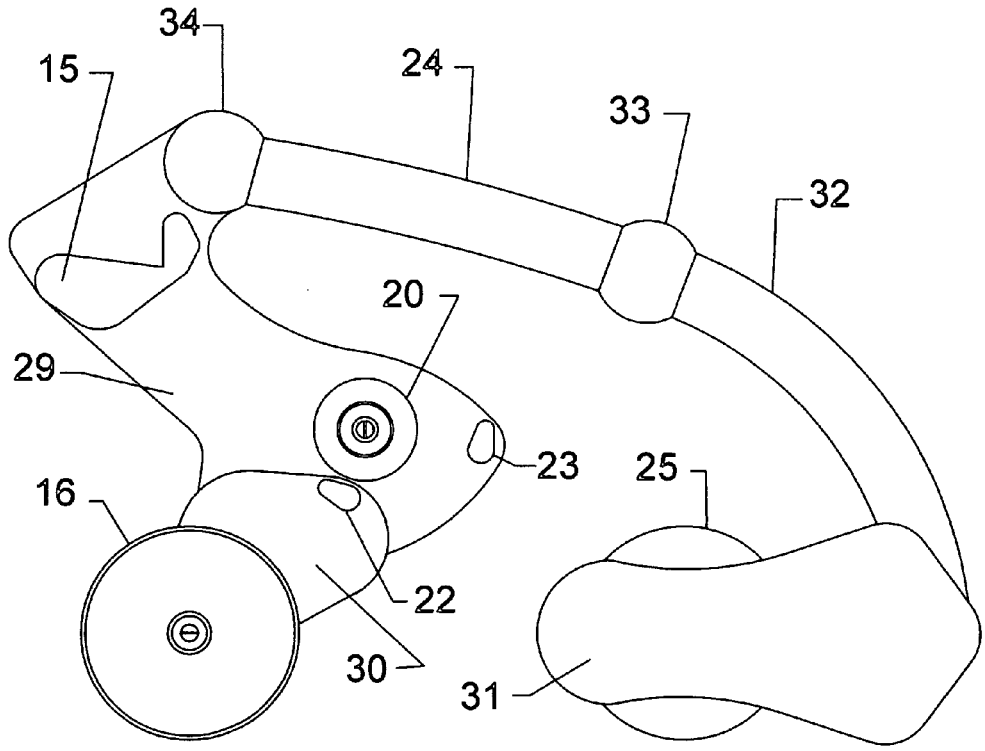
FIG. 1 is a Left Side Elevational view of a preferred tape dispenser of the present invention.
Figure 2:
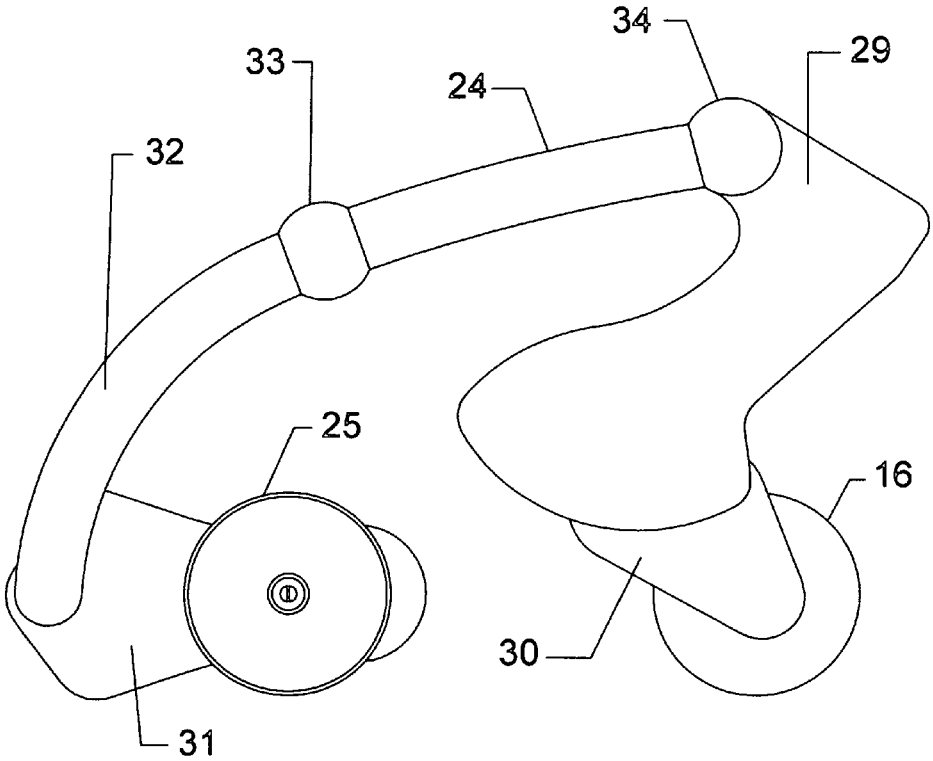
FIG. 2 is a Right Side Elevational view of a preferred tape dispenser of the present invention.
Figure 3:
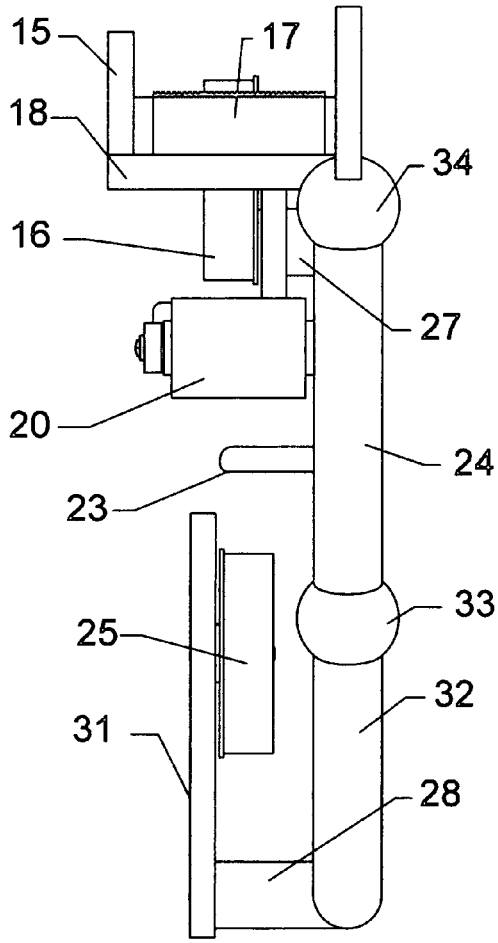
FIG. 3 is a Top Plan view of a preferred tape dispenser of the present invention.
Figure 4:
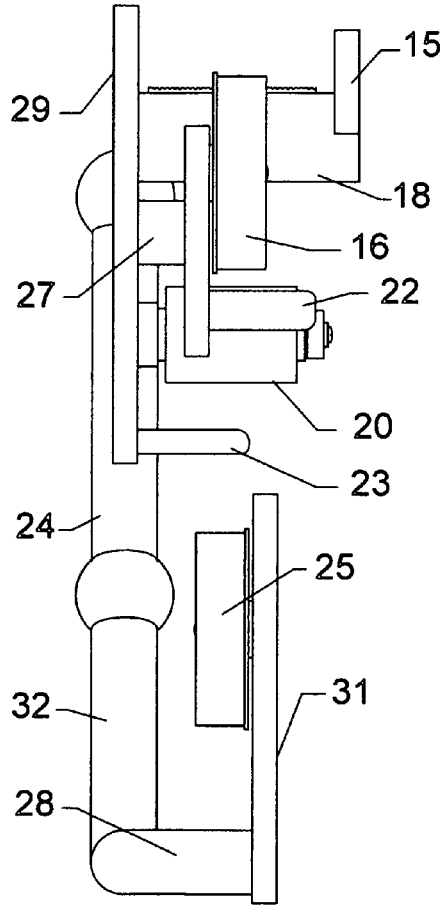
FIG. 4 is a Bottom Plan view of a preferred tape dispenser of the present invention.
Figure 5:
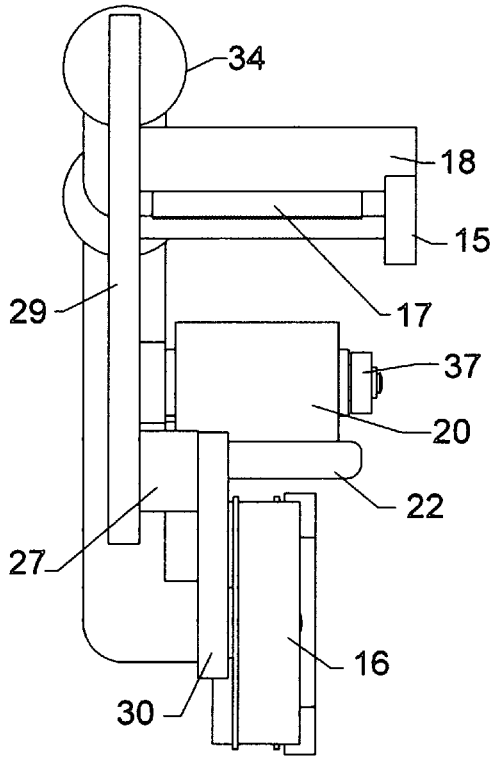
FIG. 5 is a Front Elevational view of a preferred tape dispenser of the present invention.
Figure 6:
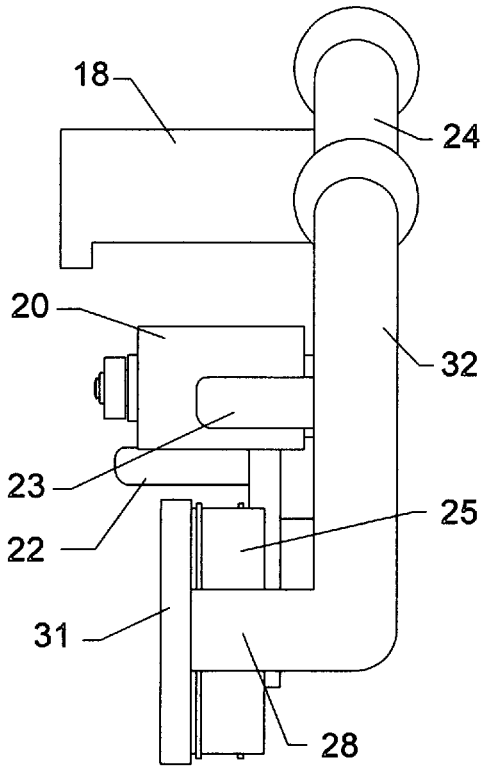
FIG. 6 is a Rear Elevational view of a preferred tape dispenser of the present invention.
Figure 10:
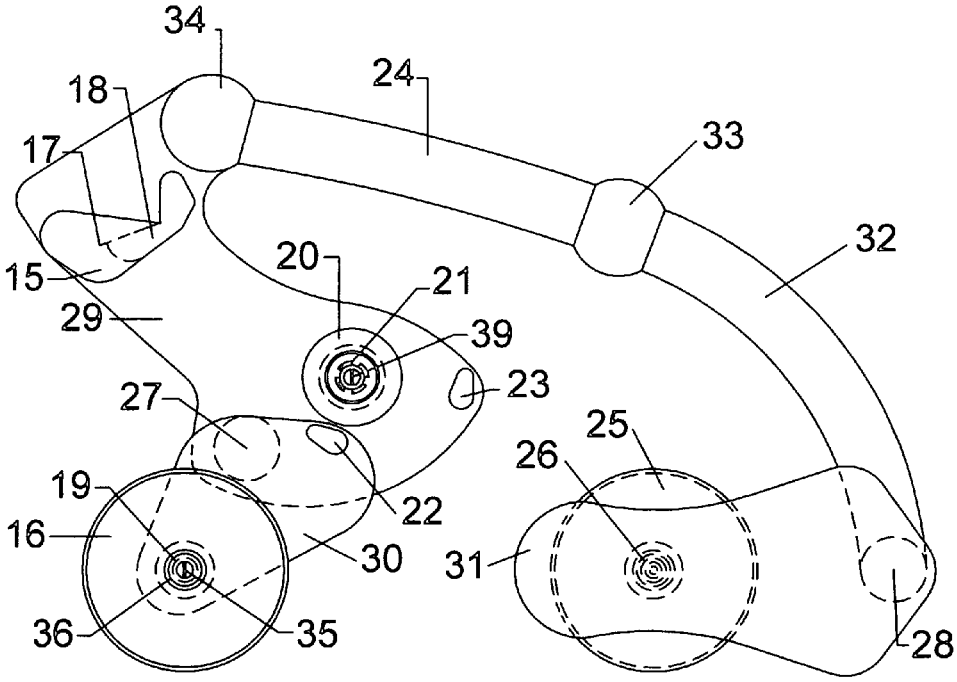
FIG. 10 is a Left Side Elevational view of a preferred tape dispenser of the present invention, with hidden lines shown.
Figure 11:
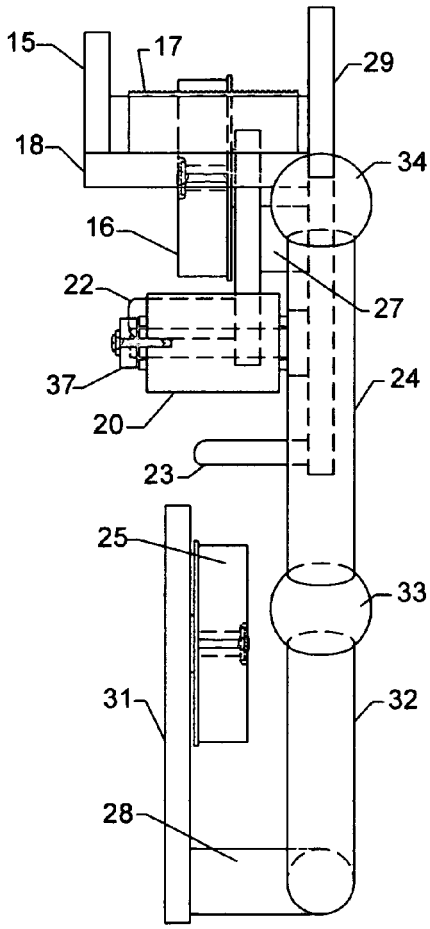
FIG. 11 is a Top Plan view of a preferred tape dispenser of the present invention, with hidden lines shown.
Figure 12:
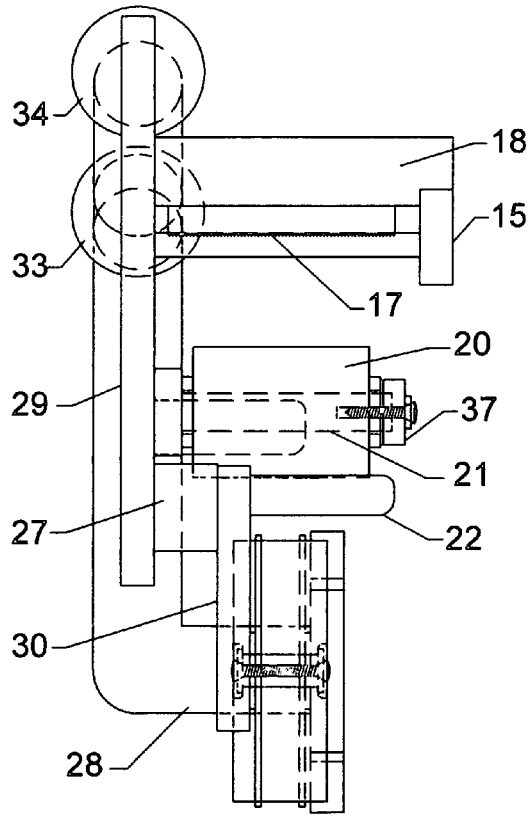
FIG. 12 is a Front Elevational view of a preferred tape dispenser of the present invention, with hidden lines shown.
Figure 16:
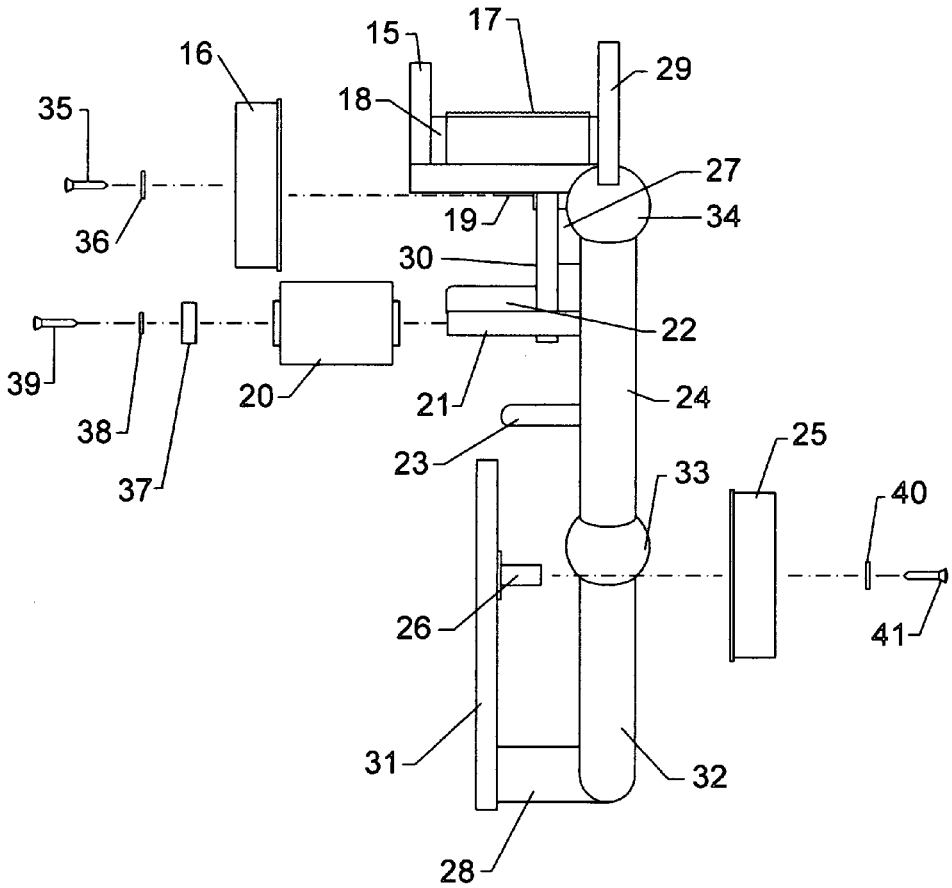
FIG. 16 is an Exploded Top Plan view of a preferred tape dispenser of the present invention.
Figure 17:
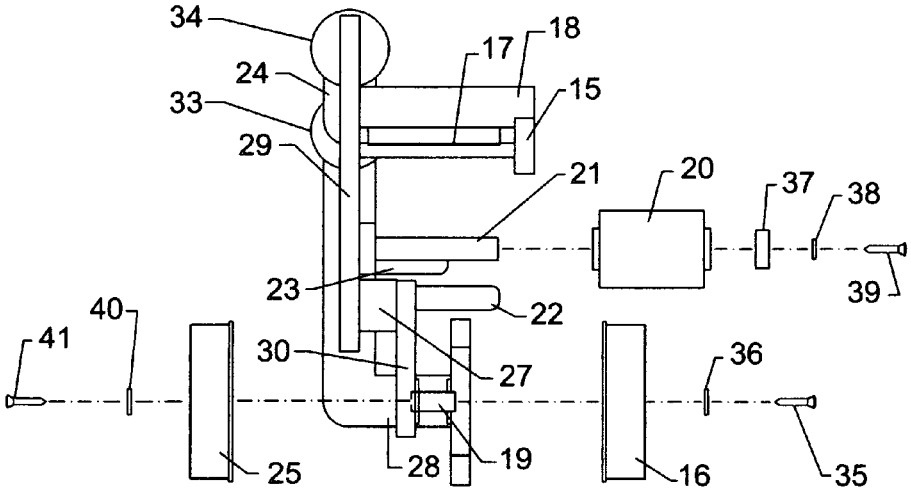
FIG. 17 is an Exploded Front Elevational view of a preferred tape dispenser of the present invention. The Rear Spool Axle is shown with hidden lines.

The Roller End Cap Screw 39 inserts into Roller End Cap Washer 38 and Roller End Cap 37 and then is screwed into Roller Axle 21. The Roller End Cap 37 could be attached by other means such as adhesively. In FIG. 19 the assembly relationship between the Rear Spool 25, Rear Spool Axle 26, Rear Spool Washer 40, and Rear Spool Screw 41 can be seen. The Rear Spool 25 is rotatably attached to the Rear Spool Axle 26 and is held in place by the Rear Spool Washer 40 and the Rear Spool Screw 41. The Rear Spool Screw 41 is inserted into the Rear Spool Washer 40 and the Rear Spool 25, then screwed into the Rear Spool Axle 26. A similar procedure is used to assemble Front Spool 16 to Lower Forward Frame Section 30. This is shown better in FIG. 20. The Front Spool 16 is rotatably attached to Front Spool Axle 19. The Front Spool Screw 35, after being inserted into the Front Spool Washer 36 and Front Spool 16, is screwed into Front Spool Axle 19. In FIG. 14 and FIG. 20 the placement of the Front Guide Member 22 on the Lower Forward Frame Section 30 can be seen. In FIG. 20 the Forward Frame Offset 27 is the common part that connects the Upper Forward Frame Section 29 to the Lower Forward Frame Section 30. In FIG. 20 the various parts of the machine can be seen. The Front Spool 16 and the Rear Spool 25 function as rotatable mounts for rolls of tape to be mounted on. The spools are aligned in an offset manner with respect to each other as shown in FIG. 11 and FIG. 3.

This offset alignment causes the tapes to overlap as they are merged together. The two guide members, Front Guide Member 22 and Rear Guide Member 23, functions are to maintain the path direction and alignment of the tape strips that are dispensed from spools. The Roller 20 is the part that the tape strips merge and are compressed together on. The Roller 20 should be wrapped or coated with a material, perhaps rubber, that would be somewhat resistant to the adhesive on the tape thus allowing the tape to pass without sticking to the roller surface. The Roller 20 also serves as a pulley, giving leverage, for tape dispensing ease. The Cutting Blade 17 is used to sever the tape strips after desired lengths are accomplished. The Cutting Blade Guard 15 serves as a safety device. The Cutting Blade Support 18 serves as a platform for the Cutting Blade 17 to be mounted on. The Cutting Blade Platform 18 bottom side is shaped so that the remaining severed tape strip will adhere to it, making it convenient to grasp and dispense. The rotatably attached parts of the machine could be secured or attached in manners other than what is illustrated in the drawings or explained in this description. As an example the Roller 20 could be attached to a non stationary axle without a Roller End Cap 37.

Mode of Operation

Figure 21:
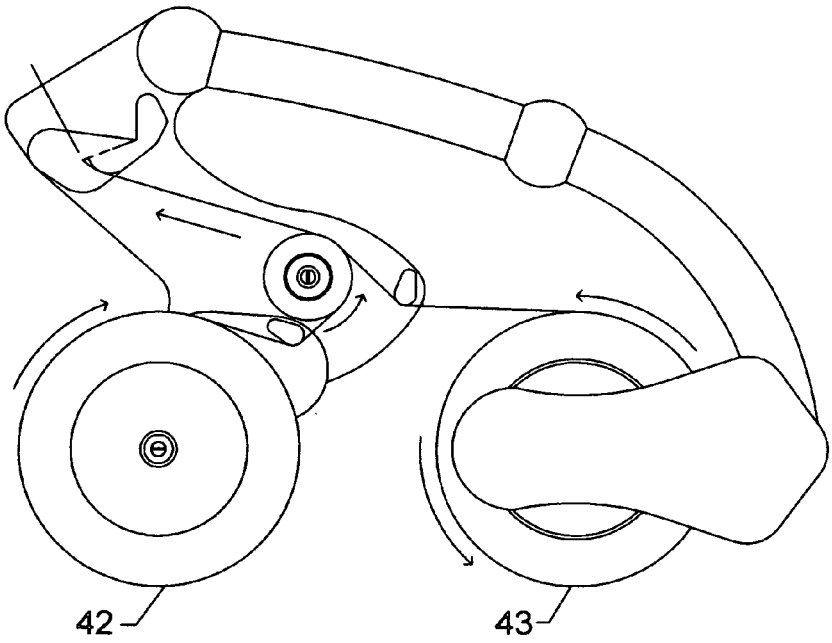
FIG. 21 is a Left Side Elevational view of a preferred tape dispenser of the present invention, shown with tape rolls loaded onto the tape spools. The tape rolls reference numbers are shown with leader lines to the corresponding tape roll. The cutting blade and cutting blade support are shown with hidden line The angled single line above the cutting blade indicates severed tape strip. The path direction of the dispensed tapes as they are threaded through the machine is indicated by arrows. The tapes are shown threaded through the machine and being severed at the cutting blade.
Figure 22:
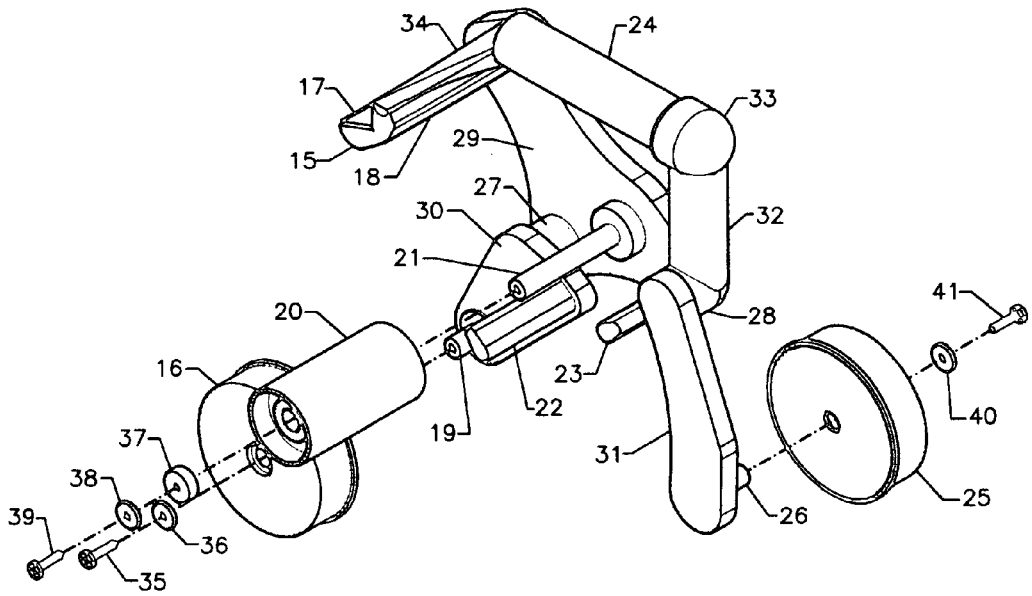
FIG. 22 is an exploded left side perspective view of a preferred tape dispenser of the present invention showing possible alternate shapes of referenced parts.

FIG. 21 shows the machine with the Front Roll of Tape 42 and Rear Roll of Tape 43 loaded onto the Front and Rear Spools. Also shown as indicated by the arrows are the paths the two dispensed tape strips follow through the machine. FIG. 18 shows the other parts referenced in this operation description. The first function or objective is to combine two separate adhesive tape strips into one tape strip that has opposing adhesive sides. The secondary objective or function is to cut the singularly formed tape strip to a desired length. The following procedure could be altered but at present it seems to be the most logical way to proceed for machine usage. The first step is to install or load the Front Roll of Tape 42 onto the Front Spool 16. The tape roll should be orientated such that the dispensed tape strip is directed toward the middle of the machine as indicated by the arrows in FIG. 21. The tape is threaded towards and below the Front Guide Member 22 then up to and around the Roller 20. The non adhesive side of the tape strip should be in contact with the Front Guide Member 22. After engaging the Roller 20 the tape strip is pulled or threaded towards, but below, the Cutting Blade 17. After the tape length extends just beyond the Cutting Blade 17 it should be raised to come in contact with the Cutting Blade 17 thereby severing the tape strip. The next step of the loading procedure is to load the Rear Roll of Tape 43 onto the Rear Spool 25. This tape roll should also be orientated such that when the tape is dispensed it should be directed towards the middle of the machine as the arrows indicate in FIG. 21.

The tape is threaded towards the underside of the Rear Guide Member 23, with the non adhesive side of the tape strip contacting the Rear Guide Member 23, then up to and over and around the top of the Roller 20. At this point the two tapes are merged together on the Roller 20. Now the two merged tape strips are pulled in a forward and downward direction and then the newly formed singular tape strip is raised to meet the Cutting Blade 17 and severed. The machine is now loaded and ready to operate. Step one, with one hand on the Handle 24 the other hand is used to pull or dispense with the same forward downward motion the newly formed singular tape strip to a desired length. Step two the tape strip is then severed by an upward motion towards the Cutting Blade 17. Repeat steps one and two for more dual sided adhesive strips.

Advantages

The current art device uses standard size rolls of adhesive tape. Its design allows for usage of varying widths of standard size rolls of adhesive tapes without having to make adjustments to the frame structure. Installing or loading tape rolls onto the spools and threading tapes through the machine is a simple process because of ease of access to the involved parts. The configuration or positioning of the various parts or members as a whole and the utilitarian design of the frame structure make possible a long needed lightweight novel device that can be used in a non-cumbersome, easy to operate, time saving, hand-held manner. These advantages will become apparent from a consideration of the description and accompanying drawings.

What is claimed is:

1. A hand-held and manually operable adhesive tape dispensing machine that can be utilized to join together separate tape strips with the end product being a singular tape strip that has partially exposed adhesive on both sides which can also be dispensed and cut to a desired length, the tape dispensing machine comprising:

a) a sectioned frame structure with a plurality of the sections connected and aligned in a vertically offset manner so that dispensed tapes will overlap one another and the center of the tape overlap will align with the center of a roller surface as the tapes engage the roller surface;

b) an upper forward frame section as one of said offset aligned sections;

c) a lower forward frame section as one of said offset aligned sections, which is connected to the upper forward frame;

d) a forward frame offset as connecting means common to the upper forward frame section and the lower forward frame section;

e) a lower rear frame section as one of said offset aligned sections, f) an upper rear frame section which is connected to the lower rear frame section;

g) a rear frame offset as connecting means common to the upper rear frame section and the lower rear frame section;

h) a front spool rotatably attached to the lower forward frame section that faces outward from the tape dispensing machine as mounting means for an adhesive tape roll;

i) a rear spool rotatably attached to the lower rear frame section as mounting means for an adhesive tape roll and facing in an opposite direction of said front spool;

j) a front guide member attached to the lower forward frame section for maintaining the path direction of tape that is dispensed from a roll of tape mounted on the front spool wherein the front guide member is a tab that is separate from said roller;

k) a rear guide member attached to the upper forward frame section for maintaining the path direction of tape that is dispensed from a roll of tape mounted on the rear spool wherein the rear guide member is a tab that is separate from said roller;

l) said roller rotatably attached to the upper forward frame section for dispensed tapes from the front and rear guide members to merge on and become compressed together;

m) a cutting blade support attached to the upper forward frame section;

n) a curved bottom side of said blade support that remaining severed tape will adhere to;

o) a cutting blade attached to the cutting blade support for severing the end product tape strip;

p) a cutting blade guard attached to the end of the cutting blade support for safety;

q) a handle for grasping by a person operating the adhesive tape dispensing machine that is also the common connecting part for the upper forward frame section and the upper rear frame section.

* * * * *